United States Patent [19]

Waters et al.

[11] Patent Number: 4,643,367

[45] Date of Patent: Feb. 17, 1987

[54] CARD WIRE WINDING TOOL AND METHOD

[75] Inventors: Oran G. Waters, Greenville; Larry G. Chandler, Senseca, both of S.C.

[73] Assignee: John D. Hollingsworth on Wheels, Inc., Greenville, S.C.

[21] Appl. No.: 733,671

[22] Filed: May 10, 1985

[51] Int. Cl.[4] ..... B21F 45/10; B65H 81/06

[52] U.S. Cl. ..... 242/7.21; 242/7.23

[58] Field of Search ..... 242/7.14, 7.15, 7.16, 242/7.21, 7.22, 7.23, 158 R; 19/112, 114; 29/452

[56] References Cited

U.S. PATENT DOCUMENTS 3,140,968 7/1964 Barrios et al. ..... 242/7.23

3,141,806 7/1964 Reinman ..... 242/1 R 3,698,651 10/1972 Miller ..... 242/7.23

*Primary Examiner*—Billy S. Taylor

*Attorney, Agent, or Firm*—Cort Flint

[57] ABSTRACT

The tool of the invention includes a wire packing element which is set in abutment with the side of carding wire being wound onto a carding drum end forces the other side of the wire into abutting fit with the previously wound wrap of wire. While so doing, the tool subjects the portion of wire just received by the drum's surface to numerous impacts while still forcing the aforesaid abutments. It is believed that these impacts alternating with reliefs from the added force causes the wire to shift minutely to attain the stablest configuration which would then not shift during use of the clothed carding cylinder but retain the desired patterning of points through long termed use.

8 Claims, 4 Drawing Figures

CARD WIRE WINDING TOOL AND METHOD

BACKGROUND OF THE INVENTION

This invention relates to an improved tool used to wind and abut toothed carding wire in adjacent helical wraps about the periphery of a carding drum or cylinder, and to an improved process therefor to obviate gaps between adjacent wraps of wire and between the wire and the drum's surface.

THE ART OF THE INVENTION

In the art of carding fibers to remove therefrom foreign matter, to axially align and straighten the fibers and to form them into the diaphaenous web called "sliver," modern practice makes use of carding cylinders or drums which have peripheries that bristle with toothed projections known as teeth. The patterned array of teeth is prescribed with a high degree of precision to permit them to coact with another toothed body, such as another clothed and toothed carding drum, to interact upon the fibers passing therebetween to effect the cleaning, aligning, straightening and forming actions described above for the end purpose of making yarn or nonwoven products.

The degree of success in these operations is largely determined by the precision with which the teeth are set down on the drum and the degree of stability in maintaining this precise patterning of points with use and time.

Critical is the ability to lay down upon the drum's surface the toothed members with prescribed precision and in such a manner that the patterning of points is maintained with use and time. This can be quite difficult and be a delicate operation requiring much care. Not only must one design, engineer and fabricate the carrier of the points, known in the art as carding wire, with great care suited to the diameter of the drum to produce the desired patterned array of points, but also one must be able to lay down the wire onto the drum's surface so that the desired precise pattern of points is obtained and is stable with use and time. It is to this vexsome problem that the invention is addressed.

Carding wire is formed from flat, elongate steel stock or wire of precise width and thickness or depth. Teeth, the points or pointed elements here spoken of, are formed in the wire by machining techniques to provide for each tooth a precise profile of exact contours in precise dimensions predetermined to achieve the results desired. Also, the wire is of a prescribed composition and temper to provide the desired properties of resilience and abrasion resistance needed to perform well for prolonged intervals of use. Other design parameters may include a particular surface finish at or along certain portions such as working surfaces of the teeth, and that the base portion from which the teeth upstand on the wire also may for special purposes be of special contours which would permit one to do what is needed in the carding of special stocks of fibers, once the wire is secured in proper alignment onto the cylindrical surface of the carding drum.

The process of alignment is one of wrapping the wire about the drum's surface repeatedly in helical abutting wraps until the whole of the surface is covered or clothed with the wire to provide the precise and predetermined patterning of points needed for any specific carding task.

In wrapping the wire, usually the drum is turned about its central axis slowly enough to receive the wire strand along a line tangential to the point of impingement of the bottom of the base portion of the wire with the drum's surface. Initially, the wire is fixed to one end of the drum's surface with a weld or similar means. Then most carefully the winds begin and continue in helical abutting fashion such that no gaps exist between adjacent wraps nor between the flat bottom of the base portion of the wire and the drum's surface. Certain special wires may have base sides which are not set perpendicular to the base bottoms, but rather at some other angle thereto including perhaps of curvilinear configuration. Such special wires present special problems to align the sequential helical wraps into side by side abutment with one another so that there are no gaps and the configuation of points is staple with use. One of these special wires in common use is what we may term "tongue and groove" which is to say that the side walls of the base portion protrude in such a fashion as to appear as a "V" set on its side.

Until the advent of the present invention, no satisfactory means or method was known to wrap wire, especially of some special base contour or profile, to assure the complete close-fitting abutments of adjacent wraps devoid of gaps having other than flat perpendicular base portion side walls. This invention comprehends such means and method.

OBJECTS OF THE INVENTION

One object of the invention is to provide an improved method for aligning consecutive wraps of carding wire in a stable configuration about the carding drum being clothed therewith so as to obviate gaps between the wire wraps and also between the wire wound and the drum's surface which they encircle.

Another object of the invention is to provide an improved tool used in winding carding wire about a drum which will assure the side by side alignment of consecutive wraps of wire such that gaps are obviated.

A further object is to provide a method and a means of the invention which will assure stability of the wrapped patterning of carding points and which will not shift with use and time.

Yet other desirable objects of the invention will become apparent from or are inherent in the following descriptions and definitions thereof.

SUMMARY OF THE INVENTION

An improved method is provided wherein during the step of abutting or packing adjacent wraps of wire being added to the carding drum's surface under a force applied to the free side of the base portion of the wire wrap being received onto the drum, repeated imposition of yet additional force is alternated with a relieving of such additional force a plurality of times per interval of time. One may impose and relieve such additional force on the order of thousands of times per minute. By this method it is found that the occurrence of gaps between adjacent wraps is obviated, and the stability of the wrapped clothed structure and its patterned array of points is enhanced.

Further, the improved tool devised to practice the foregoing process includes means for alternately applying and relieving additional force beyond the substantially constant force used to abut the latest helical wrap of wire adjacent with the preceding wrap, and joining means which rigidly joins the means for alternately applying and relieving additional force with the wire packing tool,otherwise of a conventional construction, to impart blows of additonal force to the wire wrap being wound and abutting the next previous wrap which had been wound about the drum. The means for alternately applying and relieving additional force may be in the form of a pneumatic hammer.

BRIEF DESCRIPTION OF THE DRAWINGS

A better understanding of the nature of the invention may be had from the descriptions herein when taken in conjunction with the appended drawings in which.

DESCRIPTION OF A PREFERRED EMBODIMENT

Figure 1:
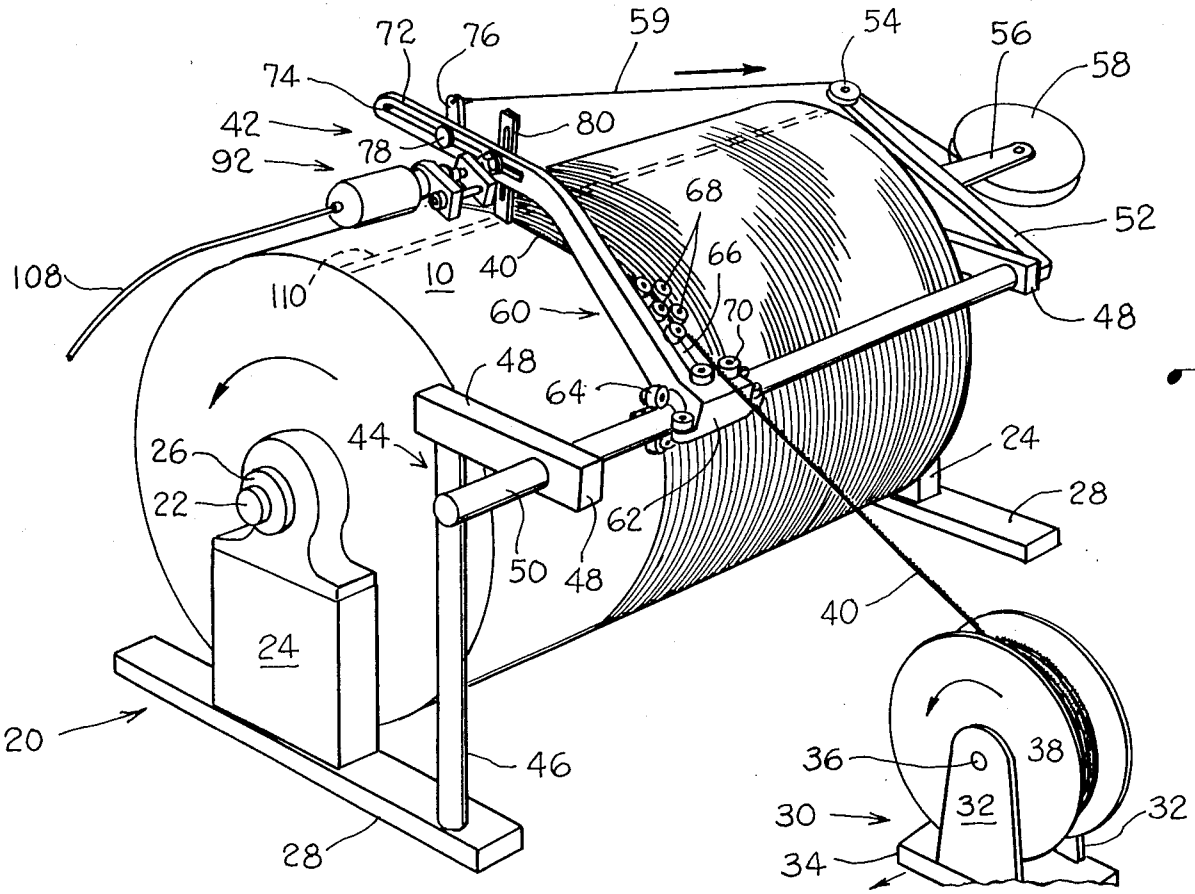
FIG. 1, in perspective view, shows a typical set-up for winding carding wire onto a carding drum employing the improved tool of the invention and practicing the method of the invention.
Figure 3:
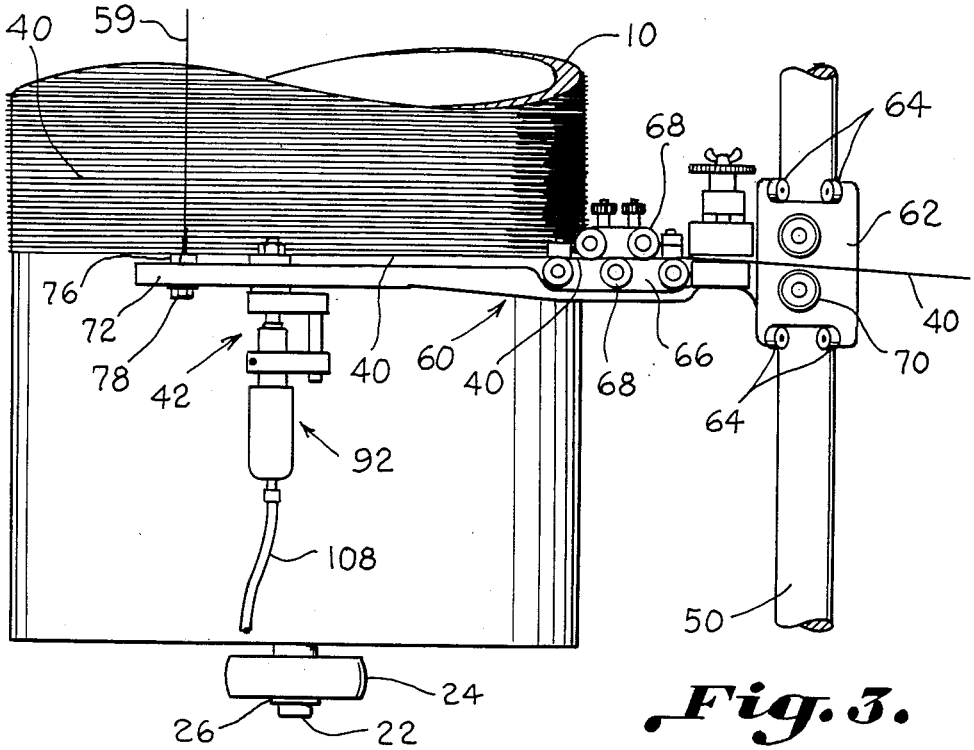
FIG. 3 is a top plan view of the elements shown in FIG. 2.
Figure 2:
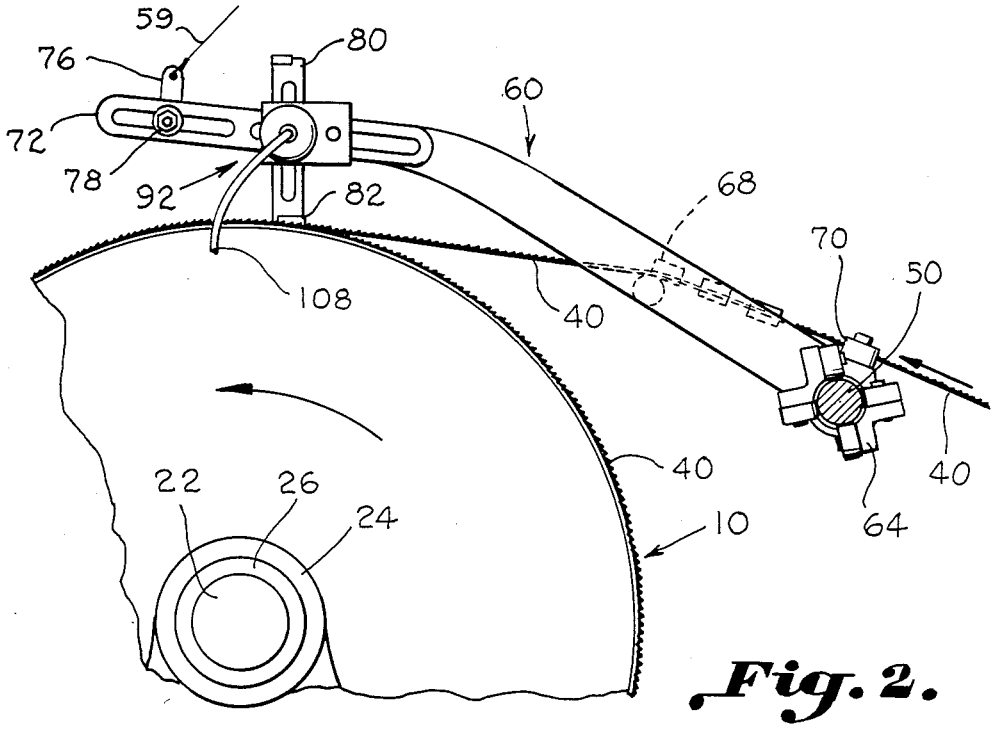
FIG. 2 is a partial side elevational view, showing the pathway of the carding wire unreeled from a source thereof from where it enters the alignment rollers of the improved tool of the invention to the point of impingement of the wire with the drum's surface and into abutting contact with the packing tool member which applies force to the side of the base portion of the wire wherein a portion of the drum shown is somewhat enlarged over that shown in FIG. 1.

In the usual process of wrapping a carding drum with wire, the carding wire is unreeled from a supply thereof and reeled onto the drum along a pathway which meets the point of impingement of the wire with the drum's surface in a substantially tangential manner, most usually by fixing the free end of the wire from its source to one end (in the drawings, the right hand end) of the drum's outer cylindrical surface with a weld or other fixing means and then unreeling the supply reel and reeling or rotating the carding drum slowly in the same rotational sense, as shown by the arrows thereon in FIG. 1. During the reeling and unreeling, the wire is kept under tension as its succeeding lengths are wrapped onto the cylinder or drum in adjacent helical winds or wraps, ultimately to completely cover the drum's surface. The last portion of wire so wrapped is then cut from further lengths and secured to the other end of the drum with another weld. Means for keeping the wire under tension and in side to side abutting relation of its adjacent wraps is effected by the winding tool which guides the received wire into correct adjacency with the preceding wrap and forces the two into the desired side by side abutting relation.

Referring now to the drawings, a typical set-up for winding carding wire onto a carding drum is shown in FIG. 1. A carding cylinder or drum, generally designated 10, is mounted for rotation upon a support therefor, generally designated 20. Rotation as shown by the arrow is in the counter- or anti-clockwis sense. Support 20 bears a support shaft or axle 22 for drum 10, and axle 22 mounted at each end thereof upon an upright or vertically extending support member 24 and in a bearing 26, with support members 24 being held upright by a pair of base members 28. Further provided is a source of carding wire in the form of a payoff reel 38 containing a supply of a strand of carding wire 40 supported upon a stand, generally designated 30. Stand 30 bears reel 38 upon an axle 36 therefor set through a pair of uprignt or vertical support members 32 on a hose member 34.

Once the free end of wire 40 is secured to one end, the right hand end as shown in the drawings, of drum 10 by a weld or other fixing means, rotation of drum 10 on axle 22 may be effected by any suitable means to reel wire 40 thereonto smoothly and evenly, such as through gearing (not shown) at the far end of axle 22 interconnectd with some power source such as manually through some crank or through some motor, all located to the right and obscured by drum 10 in FIG. 1. In turn, payoff reel 38 of carding wire 40 is rotated by the pull of drum 10 on wire 40, and in the same sense, as the arrow shows, as is drum 10. The pull of wire 40 provides the tension previously mentioned; this may be enhanced if reel 38 contains therewithin, as do some constructions, a brake or drag impediment to its rotation in the unreeling sense built into its central portion and thus is unseen in the drawings. As shown, wire 40 is pulled so that it comes off of reel 38 from the latter's top. As wire 40 progressively is wound in successive wraps onto drum 10 from right to left, reel stand 30 also is moved from right to left so that the pathway between where wire 40 leaves reel 38 and where it meets and is wrapped about drum 10 is substantially normal to the axes of reel 38 and drum 10; such moving may be manual as with the foot.

A wire winding tool, generally designated 42 and incorporating the improvement of this invention, is supported adjacent to drum 10 for traverse parallel to axle 22 upon a stand support assembly, generally designated 44. Stand 44 is shown to comprise a pair of upright or vertical posts or stanchions 46, the left hand one of which is seen to be supported by left base member 28, and right hand post 46 (which is obscured in FIG. 1 by drum 10) is supported by right base member 28. Posts 46 extend upwardly from members 28 to an elevation somewhat above that of drum axle 22. Mounted to the top portion of each of posts 46 and horizontally extending toward stand 30 is a cross bar block 48. Proximal the extended ends of cross bar blocks 48, extending therebetween and journalled therethrough each so as to extend substantially parallel to axle 22 is a cylindrical cross bar 50, which may be solid or hollow as a pipe to reduce its weight. It is on this cross bar 50 that tool 42 is supported for traverse of the axial length of drum 10.

Figure 4:
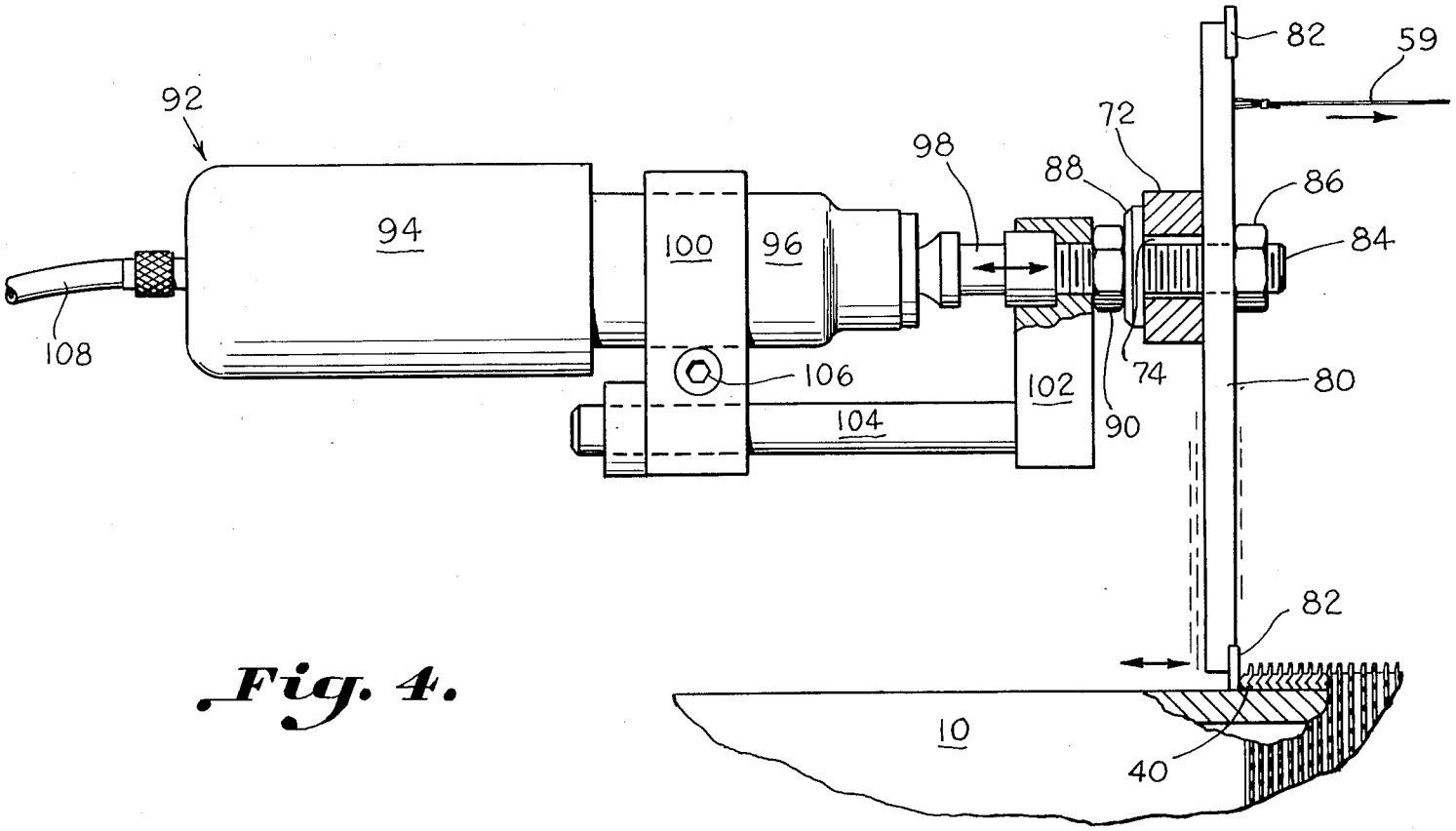
FIG. 4 enlarged side elevational view from that of FIG. 1, shows fragmentarily the improved tool of the invention in context with a portion of the carding drum being wound with a special wire having its base portion in a tongue and groove configuration.

Tool 42 also is supported by a cable 59 under tension, and is yet further supported by a part thereof resting lightly on the surface of drum 10. The former support by cable is best seen in FIG. 1 and the latter support on the drum is best seen in FIG. 4. Support by cable tension also provides the preponderance of the force applied against wire 40 as it is received onto drum 10 to force it into abutting side to side adjacency with the just previously wound wrap of wire. Support against gravity by resting on the outer surface of drum 10 also provides for the precise alignment required of the packing or force applying and imposing element of tool 42 against the free or left hand side of wire 40 as it is being received onto drum 10 for winding thereabout.

Turning now to support provided by cable, one notes that a cable brace assembly (otherwise not numbered) is rigidly fixed to right cross bar block 48. This assembly comprises a reel support brace member 52 adjustably fixed at one end to cross bar block 48 at about the same region as is right hand end of cross bar 50. Brace 52 is set beyond drum 10 at an oblique angle ascending to an elevation above drum 10 and fixed thereat. At its higher end, brace 52 supports a cable pulley wheel 54, and intermediate its ends brace 52 has fixed thereto a pair of reel brace supports 56 and a tensioning cable reel 58 held for rotation therebetween. Reel 58 contains a length or supply of tensioning cable 59, which cable 59 in turn is held against unreeling by strong tension by some tensioning means therefor such as a coil spring or the like which exerts a powerful retracting pull on cable 59 tending to resist its being withdrawn from reel 58. It is this retracting pull force which is transmitted to tool 42 and is applied against the side of the base portion of wire 40 in the abutting of its then received portion at drum 10 against the previous wind of wire 40.

To better appreciate the foregoing, one now turns to the construction of wire winding tool 42.

Tool 42, best shown in FIGS. 1 and 4, is seen to comprise an elongate slotted winding arm, generally designated 60, having at the near end a support and guide collar portion 62 which encirles traverse guide cross bar 50, to ride thereon smoothly by means of a plurality of roller bearing elements 64 which permit tool 42 to be aligned adjacent to any desired axial position along the traverse length of drum 10 for winding thereonto carding wire thereat. Extending from guide collar 62 and to the right side of arm 60 is a platform member 66 which supports a plurality of staggered wire guide and adjustment roller elements 68 for cooperation with a pair of spaced apart guide roller elements 70. Elements 70 are mounted atop collar 62 to receive from reel 38 wire 40 therebetween; and wire 40 then follows a middle pathway between staggered elements 68 for impingement with the surface of drum 10. Thereat wire 40 endures forced side to side abutment with the just preceding wrap of wire 40 about drum 10, as shall be explained below. Winding arm 60 rises from collar 62 to an elevation above the surface face of drum 10 and there is bent so that its terminal portion, a slotted end portion 72 formed with an elongate slot 74 therethrough, extends over drum 10 in a substantially horizontal disposition and in an orientation substantially normal to axle 22. End portion 72 acts as a base and a support for the adjustable positioning and fixing in place of further elements which now shall be described.

End portion 72 acts as a base and support for the free end of cable 59. Bolted to arm 60, by means of a bolt 78 through slotted portion 72, is an anchoring member 76 formed so as to receive the free end of cable 59 and anchor it there. In this manner force imparted by the tensioning of cable 59 is applied to and through tool 42 and its arm 60 to the then received wire 40 impinging against drum 10. Also bolted to arm 60 through slotted portion 72 inwardly of anchor 76 is a wire packing toll member 80 formed as an elongate bar with two ends fitted with force applying elements 82. Member 80 also is formed with an elongate slot therethrough to permit one to alter the elevation of tool 42 above drum 10 and also to choose which of the two elements 82 would be used in the wire packing step. It is by this means that one can precisely prescribe the elevation of tool 42 above drum 10 and support it there throughout the traverse of tool 42 in the axial direction, with its force applying element 82 in contact with drum 10 along a pathway 110 on the drum's surface, which pathway is indicated in FIG. 1 as bounded by the dashed parallel lines which also parallel axle 22.

Tool 42 thus far described comprises a construction known in the prior art. Using the foregoing construction, and with the exercise of much care, carding wire having planar sides, and most especially those whose sides of the base portion of wire are normal to the flat base bottom of the wire, may be successfully wrapped onto carding cylinders to form a stable array of points with time and use. However, should the base portion of the wire be of a different configuration, such as having planar sides which are set at an angle other than normal to the flat bottom, or are curvilinear, or of a complex configuration such as the tongue and groove type as shown in FIG. 4, problems are encountered in the form of instabilities which means changes in the patterning of the points with time due to less than closest abutment of adjacent sides of consecutive wire wraps, eventually producing gaps and a progressively increasing of the density of points toward one end of the drum.

It has now been found that stability of the array of points layed down is substantially enhanced by the improvements of this invention. In particular, now it has been found that if one imposes upon the cable force, which force causes element 82 to abut the free side of just received wire 40, yet an additional force repeatedly in an intermittant fashion, with a relieving of such added force between impositions, then the wrapped wire 40 clothing formed on drum 10 has an impressively improved stability with time and use.

Although it is not certain by what mechanism this inventive process step effects the substantial improvement in the wire clothing product of the wrapping method, certain possible mechanisms suggest themselves. The most prominent of these is that the added force and its alternating relieving act to shift the wire 40,at the time of its being applied by tool 42, repeatedly until wire 40 has attained its most stable orientation of side to side abutment with the just previously wound wrap of wire 40; thus, having attained its most stable positioning, wire 40 then will be able to endure the stesses imposed in carding usage without further shifting. Nevertheless, however the enhanced stability is attained, such stability is observed over prolonged use of the card wire clothing layed down by the present process, and the present improved tool 42.

A preferred embodiment is shown in all of the drawings, however the improved construction of tool 42 is best seen in FIG. 4. There one notes that the packing tool member 80 with lower end element 82 in contact with both the surface of drum 10 and also in abutting contact with the left or free side of wire 40, is shown moving toward and away from wire 40 without ever leaving abutting contact therewith, as indicated by the vertical dashed lines and the horizontal two-headed arrow. Contact we believe is never lost due to the great force exerted by cable 59 in the direction shown by the arrow proximal thereto. Member 80 is secured to arm end 72 at slot 74 by means of a bolt 84 locked into position at the desired elevation by a nut 86. Also fixed through bolt 84 and nut 86 into position adjacent to and in interconnecting rigid contact with member 80 is the present added force applying and relieving apparatus, generally designated 92, such as by means of an intermediate washer 88 and a nut 90.

Apparatus 92 comprises an electrically or pneumatically actuated impulse effector device 94 which causes reciprocatory or back and forth movement of some hammer element housed within a cylinder 96. Positioned at one end of cylinder 96 is an anvil element 98 which receives blows from that hammer element (not shown), and transmits these force impacts through bolt 84 to nuts 86 and 90 and washer 88, and thence to and through member 80 to wire 40. That hammer element, once a blow has been struck against anvil element 98, is moved away from element 98 usually thence to strike a portion of housing 96 away from element 98. Through the rigid interconnections then the whole apparatus 92 and thus tool 42 are moved somewhat away form their former impact position in essence providing a relief from the added force of hammer impact against anvil 98, as indicated by the two-headed arrow shown on element 98; however, it is believed that in all likelihood, despite the tendency for a somewhat reverse movement of member 80, the force from cable 59 is so great that end 82 never leaves contact with wire 40. However, even should momentary contact have been lost, this does not appear to provide any adverse condition mitigating the advantages provided by the invention.

Apparatus 92 is formed into a rigid unitary structure with the previously described elements and portions of tool 42 not only by means of the previously described nuts 86,90 and washer 88 and through bolt 84 but also through end clamps 100 and 102 and a joining rod 104 and a closure bolt 106 forming together interconnecting means of the invention. End clamp 100 may be a split type wherein the top two portions encircle housing 96 and are held together by bolt 106. End clamp 102 is formed with a shaped hole therethrough at its top which in part is threaded to receive therethrough threaded nut 84 and to abut therewithin a portion of anvil element 98 thus to be rigidly held in interconnection with apparatus 92 and member 80 and the rest of tool 42. The bottom portions of both clamps 100 and 102 are formed with recesses to receive therewithin, as with clamp 102, or therethrough joining rod 104. Rod 104 may be fixed to clamp 102 through a threading at its end and a complementary female threading in the recess walls of clamp 102. Clamp 100 is then positioned astride housing 96 into a desired position therealong, with its bottom aligned by rod 104. Nut 106 is tightened to rigidly clamp element 100 both to housing 96 and to rod 104. Therewith the unitary improved tool 42 is complete.

Although one may design for one's self some electrically or pneumatically actuated impulse effector 94 joined to a source of power as through an electrical or pneumatic connecting line 108, it should be noted that today there are many commercially available apparatuses which may be used to practice this invention, a knowledge of the innards of which are well known in the art and in and of themselves do not form a part of the invention. For example, they are sold under a variety of trade designations such as an "air hammer" (Dayton Electric Mfg. Co., Chicago, Ill, U.S.A.) or "auto chisel" or "air chipper" (Nitto Kohi U.S.A., Inc., Wood Dale, Ill, U.S.A.) among others (such as available from, for example, Rockwell Mfg. Co., Columbia, S.C., U.S.A. or Dresser Industries, Houston, Tex., U.S.A.). Typically, commercially available impulse effecting apparatuses usefully employed here provide reciprocatory impulses or hammer blows at rates in the range of thousands per minute, and optimally in the range of from 2,000 to 8,000 blows and reliefs per minute if pneumatically actuated, typically at air pressures of from say 85 to 90 pounds per square inch (about 6 kg/cm$^2$). These are eminently satisfactory. Some apparatuses are provided with a handle for manual manipulation, which however for present purposes serves no useful function; if one were to use such an apparatus as effector 94 and hammer and anvil constituents of tool 42, optionally the handle may be removed if desired, for the present apparatus 92 is rigidly fixed as hereinbefore described through its rigid interconnections with packing tool member 80 and the rest of tool 42.

That which is claimed is:

1. In a tool for wrapping helical wraps of card clothing toothed wire about a carding drum, including wire aligning means for aligning the toothed wire into a path tangential to the point of receipt of the wire onto the drum's surface, wire packing means for forcing the received wire at the point of receipt into side by side abutment with the previously received and wrapped helical wind of wire and into bottom abutment with the drum's cylindrical surface, and force means for applying the force desired to said wire packing means to provide said side by side abutment of consecutive helical wraps of wire, an improvement comprising added force applying and relieving means for automatically applying and relieving yet added force to said wire packing means beyond that applied by said force means in a repeated continual fashion, and interconnecting means for rigidly interconnecting said wire packing means and said added force applying and relieving means.

2. An improved tool as in claim 1, wherein said added force applying and relieving means includes means for alternately adding force to said wire packing means beyond that applied by said force means and reducing said force imparted by said force means upon said wire packing means.

3. An improved tool as in claim 1, wherein said added force applying and relieving means adds said force repeatedly on the order of thousands of times per minute to said wire packing tool.

4. An improved tool as in claim 1, wherein said added force applying and relieving means includes pneumatic means for applying said added force.

5. An improved tool as in claim 1, wherein said added force applying and relieving means includes a pneumatic hammer for applying said added force.

6. An improved process for winding card clothing wire of the type having a wire base onto a carding drum having a cylindrical surface, comprising the steps of:

a. fixing an end of card clothing wire to an end of the cylindrical surface of said drum which is to be clothed therewith such that the teeth extend outwardly therefrom;

b. reeling said wire onto said drum in the form of side by side helical wraps while applying force against the side of the wire base of said wire as it impinges onto said surface so that the wrap being wound abuts the wrap immediately previously wound upon said surface; and c. concurrently, repeatedly and alternately imposing yet additional force against said side of said base of said wire and then relieving said additional force.

7. An improved process as in claim 6, wherein said relieving of said additional force also reduces said applying force.

8. An improved process as in claim 6, wherein said imposing and relieving of said addional force is performed pneumatically.

* * * * *